US006745689B2

(12) United States Patent
Franklin et al.

(10) Patent No.: US 6,745,689 B2
(45) Date of Patent: Jun. 8, 2004

(54) PRINTING PRESS HAVING AN INKING UNIT AND METHOD OF OPERATING AN INKING UNIT

(75) Inventors: Stephen Franklin, Barrington, NH (US); Martin John Callahan, Dover, NH (US); Wolfgang Schönberger, Schriesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/241,554

(22) Filed: Sep. 11, 2002

(65) Prior Publication Data

US 2003/0047096 A1 Mar. 13, 2003

(30) Foreign Application Priority Data

Sep. 11, 2001 (DE) ..... 101 44 563

(51) Int. Cl.[7] ..... B41F 31/00
(52) U.S. Cl. ..... 101/216; 101/350.4
(58) Field of Search ..... 101/216, 350.4

(56) References Cited

U.S. PATENT DOCUMENTS 4,000,691 A * 1/1977 Fischer
4,428,291 A * 1/1984 Dorow
4,445,433 A * 5/1984 Navi ..... 101/350.4
4,488,485 A 12/1984 Bolza-Schunemann
5,009,158 A * 4/1991 John et al.
5,355,796 A * 10/1994 Köbler et al.
5,477,783 A * 12/1995 Hashimura ..... 101/158
5,511,475 A * 4/1996 Pfizenmaier ..... 101/350.2
6,055,907 A * 5/2000 Endisch et al. ..... 101/352.01
6,425,326 B1 * 7/2002 Dorenkamp et al. ... 101/352.01
6,546,869 B1 * 4/2003 Eltner et al. ..... 101/483
2003/0056674 A1 3/2003 Callahan et al.

FOREIGN PATENT DOCUMENTS

| | | |
|---|---|---|
| DE | 32 20 926 A1 | 12/1983 |
| DE | 34 32 572 A1 | 3/1985 |
| DE | 44 31 464 A1 | 3/1996 |
| DE | 196 11 048 A1 | 9/1997 |
| DE | 198 40 602 A1 | 3/2000 |
| DE | 198 40 603 A1 | 3/2000 |
| DE | 198 40 613 A1 | 3/2000 |
| EP | 0 983 849 A2 | 3/2000 |
| EP | 0 983 851 A2 | 3/2000 |
| EP | 1 291 177 A1 | 3/2003 |
| GB | 2 146 291 A | 4/1985 |

* cited by examiner

*Primary Examiner*—Eugene H. Eickholt
(74) *Attorney, Agent, or Firm*—Laurence A. Greenberg; Werner H. Stemer; Ralph E. Locher

(57) ABSTRACT

A printing press includes an inking unit provided with a screen roller having, on a circumference thereof, a pattern formed of depressions fillable with a printing medium, another roller co-operatively engageable with the screen roller, and a drive device, the screen roller and the other roller being drivingly coupled with one another so that, after each revolution of the screen roller, a pattern depicted by the printing medium on the other roller in a form of printing medium accumulations has a slight offset, in circumferential direction, with respect to a pattern depicted on the other roller during a preceding revolution of the screen roller, so that the new printing medium accumulations are positionable on the other roller in at least approximately printing-medium free gaps in, respectively, adjacent printing medium residual accumulations; and a method of operating the printing unit.

8 Claims, 3 Drawing Sheets

PRINTING PRESS HAVING AN INKING UNIT AND METHOD OF OPERATING AN INKING UNIT

BACKGROUND OF THE INVENTION

Field of the Invention

The invention relates to a printing press having an inking unit, especially a short inking unit, and to a method of operating an inking unit.

Such printing presses and methods have become known heretofore. A conventional printing press comprises an inking unit, for example an anilox inking unit, having a screen roller for metering a printing medium, for example ink or varnish, to be transferred to an ink applicator roller cooperating with the screen roller. The screen roller is formed in the circumferential surface thereof with a pattern of depressions, such as individual cells or lines, for example. The printing medium is transferred from the screen roller to a printing form, for example a plate cylinder, and from the latter to printing material. Due to the pattern of the screen roller, full-tone areas of a printed image applied to the printing material are not closed, but rather one can detect instead the fine screen roller structure, which is not desired.

In order to prevent the pattern of the screen roller from being detected on the printed image, additional rider rollers, for example, are used on the ink applicator roller, for the purpose of distributing this pattern. Disadvantages here are the costly construction of the printing unit and the fact that the additional rollers cause the inking unit to be no longer free of ghosting. Furthermore, it has become known heretofore to form the pattern of the screen roller so fine that it is no longer perceived as disruptive by the eye of an observer. However, as the pattern becomes finer, the amount of ink that is transferable, i.e., the scooping volume of the depressions formed in the screen roller and, therewith, also the density of the printed image applied to the printing material decreases. As a result, the cleaning of the screen roller is very difficult. Furthermore, the published German Patent Document DE 44 31 464 A1 discloses a device which permits a differential circumferential speed between screen roller and ink applicator roller in order to blur the printing-medium pattern on the ink applicator roller. It has been shown, however, that the printing medium film on the ink applicator roller cannot thereby be evened out in the desired manner and that for differential circumferential speeds of greater than about 5%, the printing medium density simply decreases, while the pattern in the printed image continues to remain visible.

SUMMARY OF THE INVENTION

It is accordingly an object of the invention to provide a printing press having an inking unit with which a most possibly closed full-tone area can be printed, and which preferably has a simple and cost-effective construction. A further object of the invention is to provide a method of operating an inking unit wherein a most possibly closed full-tone area is produced preferably simply.

With the foregoing and other objects in view, there is provided, in accordance with one aspect of the invention, a printing press, comprising an inking unit provided with a screen roller having, on a circumference thereof, a pattern formed of depressions fillable with a printing medium, another roller co-operatively engageable with the screen roller, and a drive device, the screen roller and the other roller being drivingly coupled with one another so that, after each revolution of the screen roller, a pattern depicted by the printing medium on the other roller in a form of printing medium accumulations has a slight offset, in circumferential direction, with respect to a pattern depicted on the other roller during a preceding revolution of the screen roller, so that the new printing medium accumulations are positionable on the other roller in at least approximately printing-medium free gaps in, respectively, adjacent printing medium residual accumulations.

In accordance with another feature of the invention, the screen roller and the other roller are coupled with one another via at least a one-stage drive gear transmission.

In accordance with a further feature of the invention, the printing press further comprises a main drive with which the other roller is coupled, and a separate motor with which the screen roller is coupled.

In accordance with an added feature of the invention, the printing press further comprises a variable-ratio gear transmission via which the screen roller and the other roller are connected to one another.

In accordance with an additional feature of the invention, the other roller is drivable at printing-press speed, and the screen roller has a selectively increasable and decreasable circumferential speed for setting a differential circumferential speed between the screen roller and the other roller.

In accordance with yet another feature of the invention, the inking unit is a short inking unit.

In accordance with another aspect of the invention, there is provided a method of operating an inking unit having a screen roller in co-operative engagement with another roller, the screen roller having, on the circumference thereof, a pattern formed of depressions fillable with a printing medium, which comprises rotating the screen roller and the other roller in a manner coordinated with one another so that after each revolution of the screen roller, the pattern depicted by the printing medium on the other roller in a form of printing medium accumulations has a slight offset in circumferential direction with respect to a pattern depicted on the other roller during a preceding revolution of the screen roller so that new printing medium accumulations are positionable on the other roller in at least approximately printing-medium free gaps in respectively adjacent printing medium residual accumulations.

In accordance with a concomitant aspect of the invention, the method is for operating a short inking unit.

Thus, the inking unit, and more specifically, a short inking unit, has a screen roller, for example an anilox roller, which has, on the circumference thereof, a pattern formed of depressions. The depressions can be filled with a printing medium, for example liquid ink or varnish. The screen roller is in contact with another roller, for example an ink applicator roller, to which the printing medium in the depressions is applied. The printing press is distinguished by the fact that the screen roller and the other roller have a drive connection with one another so that after each revolution of the screen roller, the pattern depicted by the printing medium on the other roller in the form of printing medium accumulations has a slight offset in the circumferential direction with respect to a pattern depicted on the other roller during a preceding revolution of the screen roller so that the new printing medium accumulations can be positioned on the other roller in the printing-medium free gap or approximately printing-medium free gaps in respectively adjacent printing medium residual accumulations. The printing medium in the depressions is therefore transferred to the other roller in the nip formed between the screen roller and the other roller and, on the circumferential surface of the latter, forms small printing medium accumulations which, in the circumferential direction of the other roller, are at a constant distance from one another corresponding to the pattern of depressions. In the course of a rotation of the other roller, after part of the accumulated printing medium has been discharged by splitting to a printing form co-operating with the other roller, for example a plate cylinder, printing medium residual accumulations having a volume and a height which have been reduced remain on the other roller. Between these printing medium residual accumulations are virtually printing-medium free gaps. The rolling of the screen roller and the other roller on one another is set so that when the printing-medium free gaps on the other roller are moved past the screen roller, the next, fresh printing medium accumulations are placed by the latter onto the other roller exactly in these gaps between the printing medium residual accumulations. In order to provide the gaps between the printing medium accumulations with printing medium, as distinct from heretofore known methods, these accumulations are therefore not blurred; instead, the virtually printing-medium free gaps between the printing medium residual accumulations on the other roller are filled in a controlled manner with fresh printing medium accumulations. As a result, a printing medium surface relief is produced on the other roller, the printing medium layer thickness thereof fluctuating comparatively only slightly, as a result of which the print quality is increased and continuous inking of a printed full-tone area is realizable. The pattern formed by the depressions on the screen roller can therefore not be detected in the printed image applied to a printing material.

The size of the offset between the fresh printing medium accumulation and the printing medium residual accumulation depends upon the distance from one another of the depressions provided on the screen roller. If, for example, the screen roller has a cell or line pattern, then, for example up to 50 lines can be provided in one centimeter. Here, the distance between two adjacent lines can lie in a range from a few hundredths of a millimeter up to a very few tenths of a millimeter.

In the case of likewise suitable screen roller engraving, the screen roller pattern is formed by cells or lines, of which more than 100 can be arranged on one centimeter. It becomes clear that the offset must be extremely precise in order that the new printing medium accumulations are placed exactly in the printing-medium free gaps or approximately printing-medium free gaps of respectively adjacent printing medium residual accumulations on the other roller.

In an advantageous exemplary embodiment of the printing press, provision is made for the screen roller and the other roller to be coupled with one another via a single-stage or multi-stage drive gear transmission. In a particularly advantageous variation in construction, the overall transmission ratio "i" of the drive gear transmission is selected, and the diameter $d_R$ of the screen roller and the diameter $d_W$ of the other roller are coordinated with one another in such a way that the circumferential speed difference is zero, i.e., the screen roller and the other roller roll on one another without slip, but nevertheless, following each revolution of the screen roller, the pattern depicted on the other roller having a slight offset in the circumferential direction so that the new printing medium accumulations are placed on the other roller in the virtually printing-medium free gaps of respectively adjacent printing medium residual accumulations. This is realized, for example, by the transmission ratio being 1:1.999, the diameter $d_W$ of the other roller being 200 mm, and the diameter $d_R$ of the screen roller being 100.05 mm. The diameter $d_W$ of the other roller is preferably the same as the diameter of a plate cylinder in contact with the other roller.

Furthermore, the method of the invention provides for the screen roller and the other roller to rotate on one another in a manner coordinated so that after each revolution of the screen roller, the pattern depicted by the printing medium on the other roller in the form of printing medium accumulations has a slight offset in the circumferential direction with respect to a pattern depicted on the other roller during a preceding revolution of the screen roller, so that the new printing medium accumulations can be positioned on the other roller in the printing-medium free gaps or approximately printing-medium free gaps in respectively adjacent printing medium residual accumulations. The offset can be implemented both in the direction of rotation of the rollers and counter to the direction of rotation of the rollers.

Other features which are considered as characteristic for the invention are set forth in the appended claims.

Although the invention is illustrated and described herein as embodied in a printing press having an inking unit, and a method of operating an inking unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
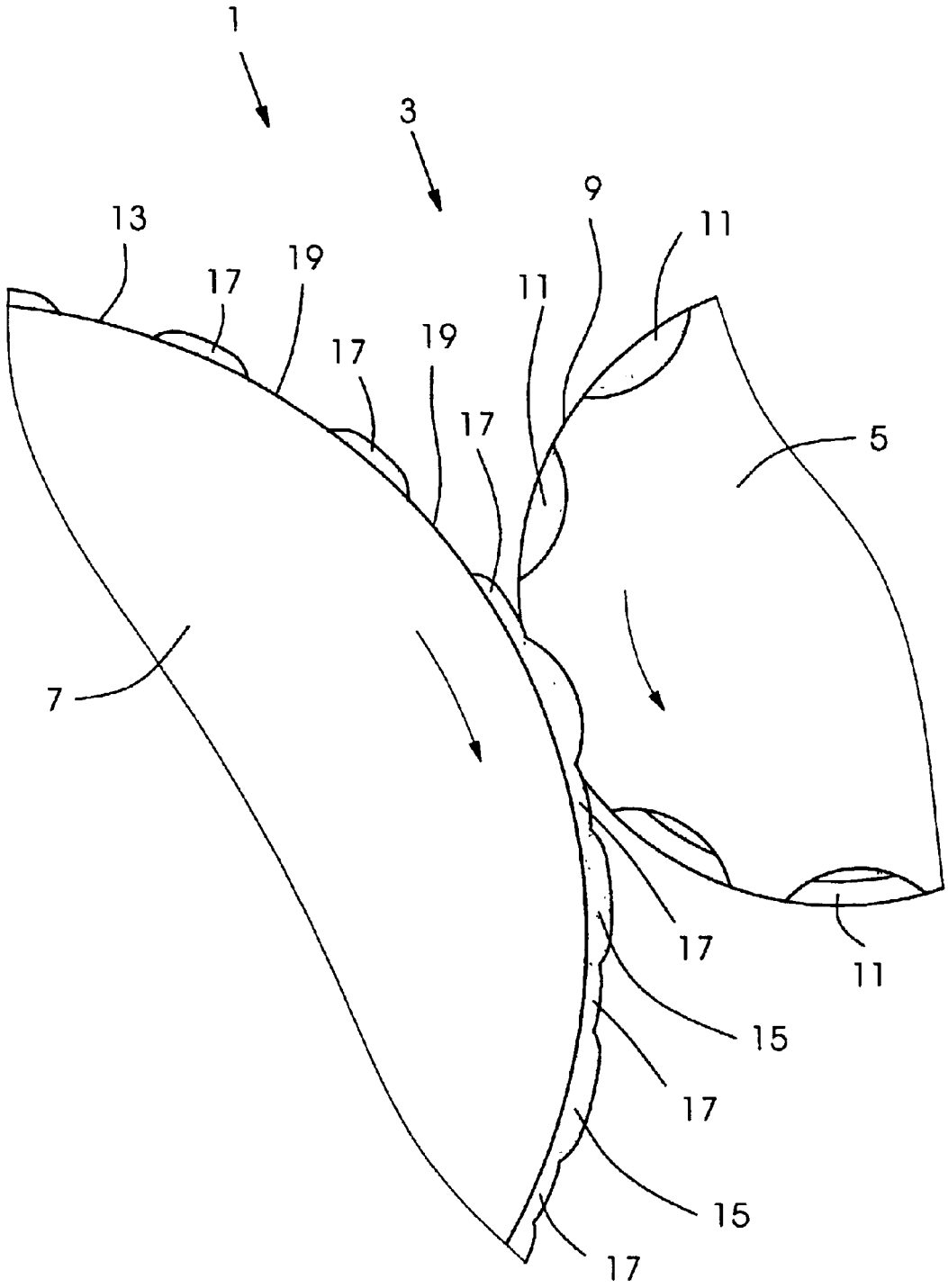
FIG. 1 is a fragmentary diagrammatic side elevational view of an exemplary embodiment of a printing press, namely two rollers rolling on one another.

Referring now to the drawings and, first, particularly to FIG. 1 thereof, there is shown therein a printing press 1 which is described hereinafter. Purely by way of example, it is assumed that the printing press 1 is an offset printing press which is operated in the wet offset or dry offset process. The printing medium selected for printing a printing image onto a printing material, for example a sheet or a web of paper, board, plastic material or sheetmetal, may be liquid or pasty ink or varnish, for example. In the hereinafter following text, it is assumed that a liquid ink is being used here.

FIG. 1 shows part of an exemplary embodiment of the printing press 1, namely an inking unit 3, which is formed here as an anilox inking unit. The inking unit 3 comprises a screen roller 5, also known as an anilox roller, which is in contact with another roller 7, i.e., the screen roller 5 and the other roller 7 roll on one another. Here, the other roller 7 is formed as an ink applicator roller having a rubber-elastic cover, which co-operates with a plate cylinder that is not illustrated in FIG. 1. The diameter of the other roller 7 is preferably the same as that of the plate cylinder, in this exemplary embodiment the diameter of the screen roller 5 being half that of the other roller 7.

Provided in the circumferential surface 9 of the screen roller 5 are depressions 11 which are arranged at equal distances from one another, forming a pattern. The depressions 11 are formed here as cells, the cell geometry and the cell distribution determining the scooping volume of the screen roller. The depressions 11 fillable with ink, and a doctor-blade device, not illustrated in FIG. 1, which wipes or scrapes off the circumferential surface 9 of the screen roller 5, ensure that the depressions 11 are reproducibly filled with ink and, therefore, a prescribed volume of ink is always transferred to the other roller 7.

The screen roller 5 and the other roller 7 are drivable by a drive device that is not illustrated in FIG. 1, a small circumferential speed difference being set between the screen roller 5 and the other roller 7, i.e., there is slip between the rollers 5 and 7, as is discussed hereinafter. In order to set a desired circumferential speed difference, provision is preferably made for a non-illustrated control device, by which the drive device is controlled.

From the depressions 11 in the screen roller 5, ink is transferred to the circumferential surface 13 of the other roller 7 and forms, on the latter, small ink accumulations 15 (printing medium accumulations) which, as viewed in the circumferential direction of the other roller 7, are at a constant distance from one another. In this regard, the depressions 11 of the screen roller 5 are partly emptied. Due to the ink accumulations 15, the pattern and the structure, respectively, of the screen roller 5 is depicted on the circumferential surface 13 of the other roller 7. The ink accumulations 15 applied to the other roller 7 are not transferred completely to the plate cylinder, because ink splitting takes place, and instead, part of each of the ink accumulations 15 remains on the other roller 7. These remaining ink accumulations are referred to as residual ink accumulations 17 (printing medium residual accumulations) hereinafter. Ink-free gaps 19 are located between respectively adjacent residual ink accumulations 17. As is apparent from FIG. 1, the residual ink accumulations 17 have a lower ink volume and a lower height than the ink accumulations 15, because, respectively, a part of the ink accumulations 15 has been transferred to the plate cylinder due to ink splitting.

The enrolling relationships of the screen roller 5 and the other roller 7 are selected so that as the gaps 19 pass the screen roller 5 in the region of the nip, the new ink accumulations 15 are, respectively, set on and transferred to the other roller 7 by the screen roller 5 precisely in the gaps 19 between the residual ink accumulations 17. A continuously inked ink film is consequently formed on the circumferential surface 13 of the other roller 7, the thickness of the ink film fluctuating only slightly. Due to the continuous inking, a closed full-tone area can be printed on the printing material, the pattern on the screen roller being not recognizable in this area. For this purpose, therefore, no additional rollers or other equipment are needed for spreading or wiping the ink accumulations 15, such as are used in conventional printing presses.

A gap 19 completely free of printing medium, which is located between adjacent residual ink accumulations 17, ultimately exists only after a first revolution of the other roller 7. After the gaps 19 have passed the nip, the previously ink-free gaps 19 are provided with ink accumulations 15, so that a closed ink film is formed, as illustrated in FIG. 1, on that part of the circumferential surface 13 of the other roller 7 which is arranged downstream from the nip. Because, during each revolution of the other roller 7, parts of the ink accumulations 15 and of the residual ink accumulations 17 are transferred to the plate cylinder, it is finally only the thickness of the ink film which fluctuates.

Figure 2:
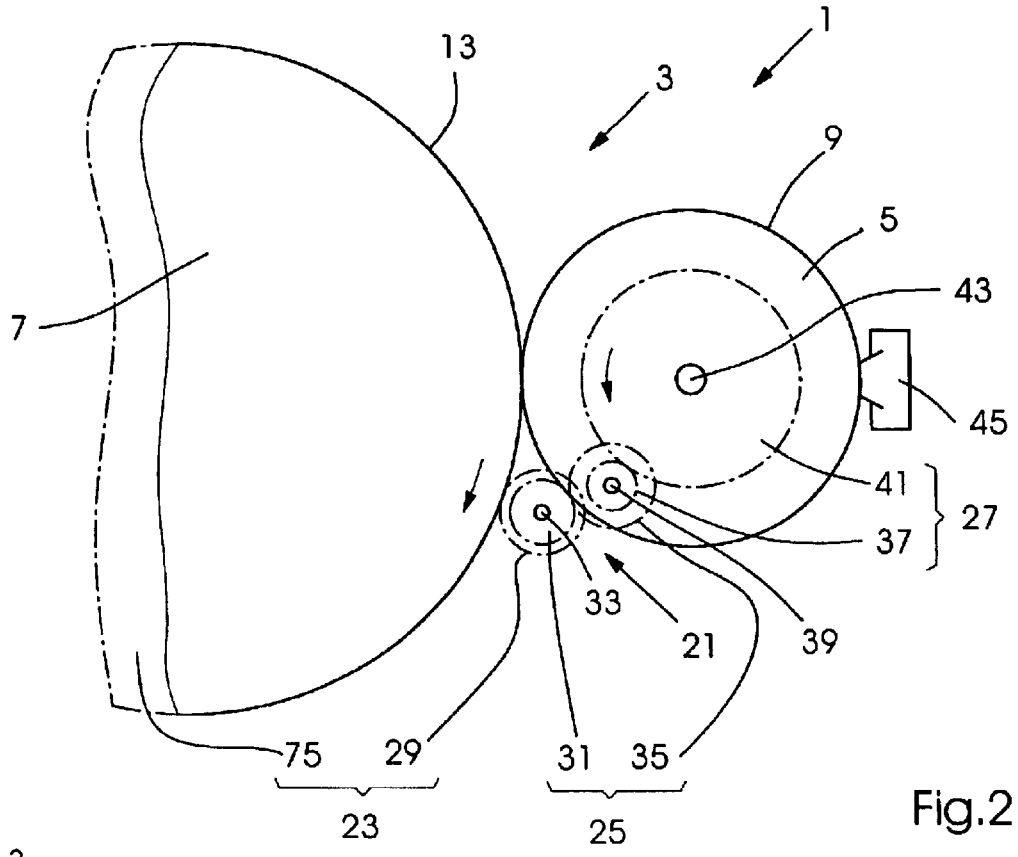
FIG. 2 is a fragmentary diagrammatic side elevational view of an exemplary embodiment of a multistage drive gear transmission for the rollers of the printing press.

FIG. 2 shows a fragment of a further exemplary embodiment of the printing press 1, namely the screen roller 5 and the other roller 7, which are coupled with one another via a multistage drive gear transmission 21. The drive gear transmission 21 is part of the drive device for the rollers 5 and 7. The drive gear transmission 21 comprises a first gear transmission stage 23, a second gear transmission stage 25 and a third gear transmission stage 27. The drive gear transmission 21 has a first gear 29 and a second gear 31, which are firmly connected to a shaft 33 so as to rotate therewith, and also a third gear 35 and a fourth gear 37, which are firmly connected to a shaft 39 so as to rotate therewith. The drive device 21 further comprises a fifth gear 41, which is firmly connected so as to rotate with a bearing pin 43 of the screen roller 5. The first gear 29 and a gear 75 coupled with the other roller 7 form the first gear transmission stage 23, the intermeshing gears 31 and 35 form the second gear transmission stage 25, and the gears 37 and 41 form the third gear transmission stage 27. The overall transmission ratio of the drive gear transmission 21 is selected so that, as described with respect to FIG. 1, the ink accumulations 15 are positioned in the gaps 19 between the residual ink accumulations 17, the circumferential speeds of the screen roller 5 and of the other roller 7 preferably being equal to one another or differing slightly from one another.

In addition, in the diagrammatic view of FIG. 2, a doctor-blade device 45 assigned to the screen roller 5 is illustrated in the form of a chamber-type doctor blade, for example.

In an exemplary embodiment not illustrated in the figures, the drive gear transmission is of single-stage construction, i.e., only two gears are provided, of which a first gear is coupled with the other roller 7 and a second gear is coupled with the screen roller 5, with both of the gears intermeshing.

Figure 3:
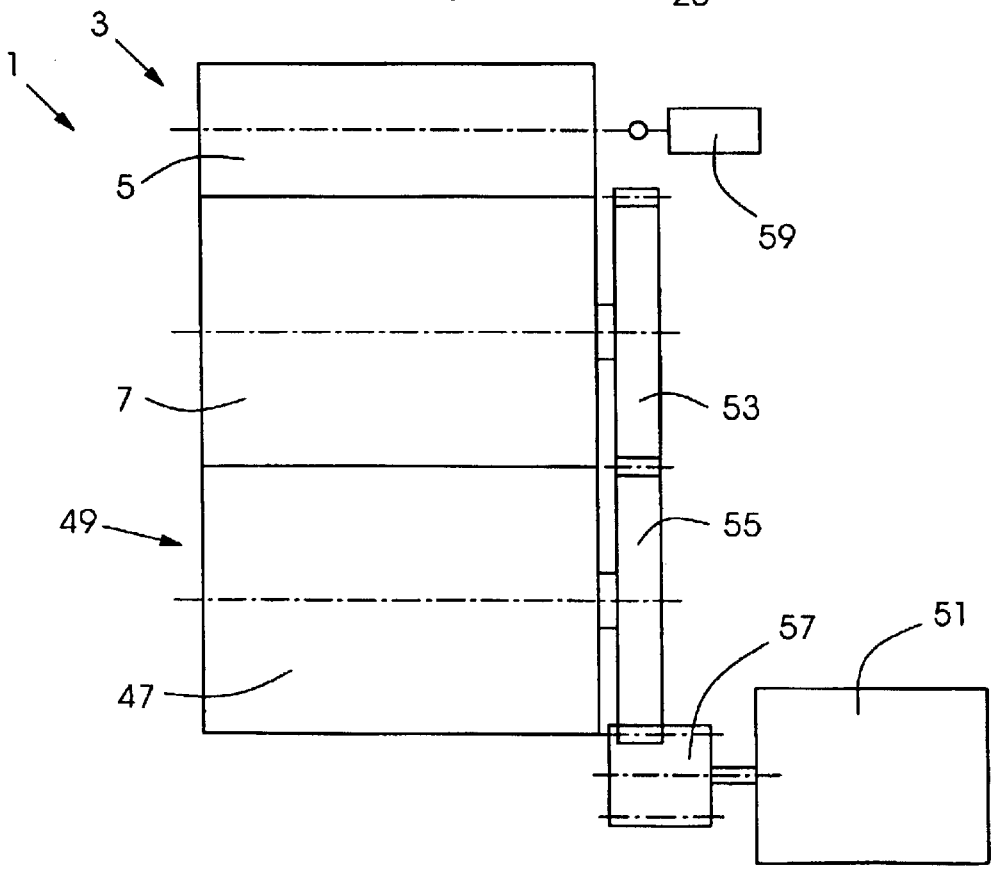
FIG. 3 is a diagrammatic top plan view of a further exemplary embodiment of a drive device for the rollers in the printing press, as viewed in the machine running direction.

FIG. 3 is a diagrammatic top plan view of an exemplary embodiment of the printing press 1 in the region of the inking unit 3. Here, a printing form 49 formed by a plate cylinder 47 is shown, which is in contact with the other roller 7. Also shown is a further exemplary embodiment of the drive device. The other roller 7 is coupled with a main drive 51 of the printing press 1. For this purpose, a gear 53 connected to the other roller 7 and a gear 55 connected to the plate cylinder 47 are provided. The gear 55 meshes with the gear 53 and with a gear 57 connected to the main drive 51. In this exemplary embodiment, the gears 53 and 55 have the same rotational speeds, so that the other roller 7 and the plate cylinder 47, which are of the same diameter, roll on one another without slip. The screen roller 5 is coupled with a separate motor 59, so that a desired circumferential speed difference between the screen roller 5 and the other roller 7 can be performed by influencing the motor control system. The exemplary embodiment of the drive device illustrated in FIG. 3 offers the advantage that the circumferential speed difference can be set optimally for every desired pattern on the screen roller 5. With the aid of the separate motor 59, therefore, an extremely small transmission ratio can be realized, so that the screen roller 5, for each revolution in the circumferential direction, i.e., in or counter to the direction of rotation thereof, has an offset with respect to the other roller 7 which is preferably a few tenths of a millimeter or hundredths of a millimeter.

Figure 4:
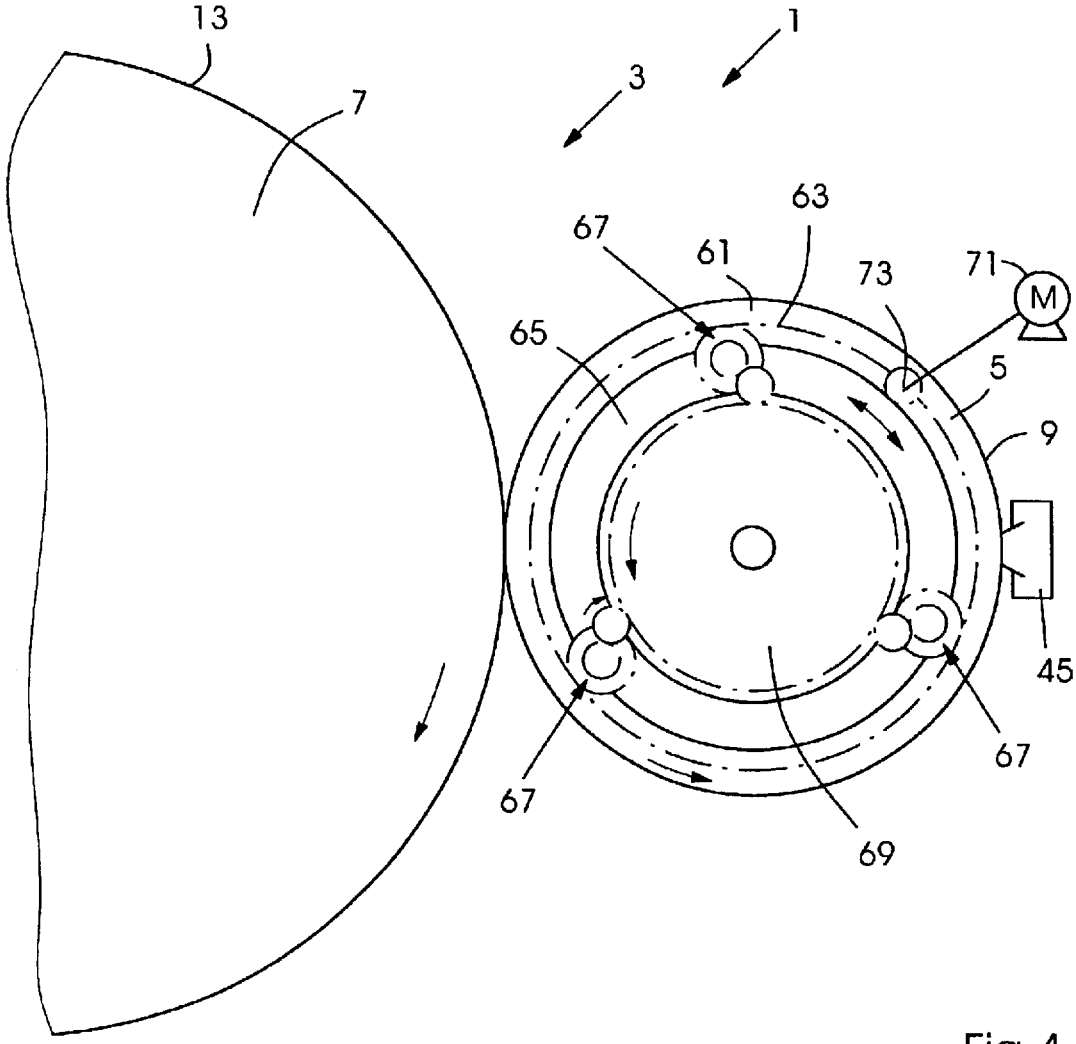
FIG. 4 is a fragmentary diagrammatic side elevational view of a third exemplary embodiment of the drive device for the rollers.

FIG. 4 shows a fragmentary side elevational view of a further exemplary embodiment of the printing press 1, wherein the screen roller 5 is also driven via gears by the main printing-press drive, which is otherwise not specifically illustrated here. The offset between the fresh printing medium accumulations and the residual printing medium accumulations is brought about by a variable-ratio gear transmission 61. In this exemplary embodiment, the non-illustrated plate cylinder, the other roller 7 and the screen roller 5 are connected to one another via gears in a single plane. The variable-ratio gear transmission 61 here is formed by a planetary or epicyclic gear train, which comprises a gear 63 with internal toothing, a web or flange 65 whereon three planet gears 67 arranged in pairs are arranged so as to be rotatable, and a gear 69 firmly connected so as to rotate with the screen roller 5. The gear layout is selected here so that during a conceivable standstill of a motor 71 and, therefore, with the web 65 at a standstill, the screen roller would rotate twice when the other roller 7 had made one revolution. During operation, the web 65 is rotated so slowly by the motor 71 that the overall transmission ratio of the variable-ratio gear transmission 61 is set so as to correspond to the cell and line structure of the screen roller 5, respectively, which is used, and so that the inking of the other roller 7 is again such that the ink accumulations 15 are positioned in the gaps 19 between the residual ink accumulations 17.

The motor 71 needs only very little power to rotate the web 65 and can, therefore, be constructed to be correspondingly small. In addition, high accuracy for setting the circumferential speed difference between the screen roller 5 and the other roller 7 can be adjusted easily, because the motor 71 has a high transmission ratio for the slowly running pinion 73 thereof, as a result of which the resolution is also multiplied. The embodiment shown in FIG. 4 also offers the advantage that, in the event of failure of the motor 71, it is always possible to continue printing, even if no longer as desired, because the circumferential speed difference between the screen roller 5 and the other roller 7 is then zero.

As an alternative to the variable-ratio gear transmission 61 described with regard to FIG. 4, it is of course also possible to use other ways for producing a very small, exactly adjustable circumferential speed difference between the screen roller 5 and the other roller 7.

We claim:

1. A printing press, comprising an inking unit provided with a screen roller having, on a circumference thereof, a pattern formed of depressions fillable with a printing medium, another roller co-operatively engageable with said screen roller, and a drive device, said screen roller and said other roller being drivingly coupled with one another so that, after each revolution of said screen roller, a pattern depicted by said printing medium on said other roller in a form of printing medium accumulations has a slight offset, in circumferential direction, with respect to a pattern depicted on said other roller during a preceding revolution of said screen roller, so that the new printing medium accumulations are positionable on said other roller in at least approximately printing-medium free gaps between, respectively, adjacent printing medium residual accumulations.

2. The printing press according to claim 1, wherein said screen roller and said other roller are coupled with one another via at least a one-stage drive gear transmission.

3. The printing press according to claim 1, further comprising a main drive with which said other roller is coupled, and a separate motor with which said screen roller is coupled.

4. The printing press according to claim 1, further comprising a variable-ratio gear transmission via which said screen roller and said other roller are connected to one another.

5. The printing press according to claim 1, wherein said other roller is drivable at printing-press speed, and said screen roller has a selectively increasable and decreasable circumferential speed for setting a differential circumferential speed between said screen roller and said other roller.

6. The printing press according to claim 1, wherein said inking unit is a short inking unit.

7. A method of operating an inking unit having a screen roller in co-operative engagement with another roller, the screen roller having, on the circumference thereof, a pattern formed of depressions fillable with a printing medium, which comprises rotating the screen roller and the other roller in a manner coordinated with one another so that after each revolution of the screen roller, the pattern depicted by the printing medium on the other roller in a form of printing medium accumulations has a slight offset in circumferential direction with respect to a pattern depicted on the other roller during a preceding revolution of the screen roller so that new printing medium accumulations are positionable on the other roller in at least approximately printing-medium free gaps between respectively adjacent printing medium residual accumulations.

8. The method according to claim 7, wherein the inking unit is a short inking unit.

* * * * *